US007448705B2

(12) United States Patent
Park

(10) Patent No.: US 7,448,705 B2
(45) Date of Patent: Nov. 11, 2008

(54) SIDE-BY-SIDE REFRIGERATOR

(75) Inventor: Sang Min Park, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 462 days.

(21) Appl. No.: 11/146,325

(22) Filed: Jun. 7, 2005

(65) Prior Publication Data

US 2006/0097612 A1 May 11, 2006

(30) Foreign Application Priority Data

Nov. 5, 2004 (KR) ..... 10-2004-0090035

(51) Int. Cl.
*A47B 96/00* (2006.01)

(52) U.S. Cl. ..... 312/405; 49/340

(58) Field of Classification Search ..... 312/401, 312/405, 319.2, 319.5, 324; 292/44, 45, 292/46, 49, 197, 200, 210, 215, DIG. 68; 49/136, 324, 339, 340
See application file for complete search history.

(56) References Cited

U.S. PATENT DOCUMENTS 1,878,796 A * 9/1932 Morse et al. ..... 160/188
3,216,776 A * 11/1965 Carbary ..... 312/296
3,533,669 A * 10/1970 Steglich ..... 312/8.16
5,906,423 A 5/1999 Lyu
5,983,453 A * 11/1999 Miwa ..... 16/231
6,802,155 B1 * 10/2004 Kawabata et al. ..... 49/192

FOREIGN PATENT DOCUMENTS

CN 1213766 A 4/1999
JP 2002-257466 * 9/2002
KR 20-297199 11/2002
KR 20-336470 12/2003

OTHER PUBLICATIONS

The First Office Action issued by the State Intellectual Property Office of People's Republic of China in Application No. 200510076132.3 (2 pages) with an English language translation (3 pages); Details of the First Office Action (2 pages of English translation).
Patent Abstracts of Japan for Publication No. 2002-257466, dated Sep. 11, 2002.
Korean Patent Abstracts for Publication No. 1020030046220, dated Jun. 12, 2003.
Patent Abstracts of Japan for Publication No. 2003-240424, dated Aug. 27, 2003.
Patent Abstracts of Japan for Publication No. 2004-068440, dated Mar. 4, 2004.

* cited by examiner

*Primary Examiner*—James O Hansen
(74) *Attorney, Agent, or Firm*—Staas & Halsey LLP

(57) ABSTRACT

A side-by-side refrigerator having a door-opening apparatus for easily opening doors. The opening apparatus includes a driving motor, a main cam rotated by the driving motor, and first and second sub-cams operated by the main cam. The first and second sub-cams are rotated by the main cam, and are partially protruded to the outside, thereby respectively opening the left and right doors.

5 Claims, 4 Drawing Sheets

SIDE-BY-SIDE REFRIGERATOR

CROSS-REFERENCE TO RELATED APPLICATIONS

This application claims the benefit of Korean Patent Application No. 2004-90035, filed Nov. 5, 2004, in the Korean Intellectual Property Office, the disclosure of which is incorporated herein by reference.

BACKGROUND OF THE INVENTION

1. Field of the Invention

The present invention relates to a side-by-side refrigerator, and more particularly, to a door-opening apparatus and method for easily opening doors of a side-by-side refrigerator.

2. Description of the Related Art

Generally, a refrigerator serves to store food in a fresh state for a long period of time, and includes a refrigerating cycle for cooling storage chambers, which store foods. According to the recent increase in demand for large-sized and high-quality refrigerators, a side-by-side refrigerator, the inside of which is divided into left and right storage chambers having large capacities, has been developed.

The inside of a cabinet of the side-by-side refrigerator is divided into the left and right storage chambers. Usually, the left storage chamber is used as a freezing chamber, and the right storage chamber is used as a chilling chamber. Apparatuses, such as a dispenser for easily taking ice cubes or water out of the storage chambers or a home-bar for easily taking a beverage bottle out of the storage chambers, may be additionally installed on doors for opening and closing the freezing and chilling chambers.

A user opens the door, and places or removes food in or from the storage chamber. In order to prevent cold air in the storage chamber from leaking to the outside or external air from being introduced into the storage chamber, a gasket made of rubber is installed on the circumference of the inside of the door, thereby hermetically closing the storage chamber. Accordingly, when the door is closed, the air communication between the insides of the storage chamber and the outside is cut off.

When the door is opened and then closed, external air is introduced into the storage chamber. The introduced external air is gradually cooled as time goes by, and is reduced in specific volume, thereby decreasing the pressure in the storage chamber compared to that of the outside. Accordingly, when the user wants to re-open the door, the user must apply force, having a degree for overcoming a difference of pressures between the storage chamber and the outside, to the door. As occasion demands, the user must apply comparatively large force to the door so as to open the door. Particularly, in a side-by-side refrigerator comprising doors having a heavy weight and storage chambers having a large capacity, the above problem is severely generated, thereby providing inconvenience to the user.

In order to solve the above problem, Japanese Patent Laid-open Publication No. 2002-257466 discloses a door-opening apparatus for a refrigerator, which uses a cam driven by a motor. In order to apply the door-opening apparatus to a side-by-side refrigerator, the door-opening apparatus must be installed on each of two doors of the side-by-side refrigerator, thereby increasing production costs of the refrigerator and reducing the productivity of the refrigerator.

SUMMARY OF THE INVENTION

Additional aspects and/or advantages of the invention will be set forth in part in the description which follows and, in part, will be apparent from the description, or may be learned by practice of the invention.

Therefore, one aspect of the invention is to provide a side-by-side refrigerator having a door-opening apparatus, which easily opens doors of the refrigerator and has a simple structure, thereby having reduced production costs.

Another aspect is to provide a method of opening the doors of a side-by-side refrigerator.

In accordance with one aspect, the present invention provides a side-by-side refrigerator comprising: a cabinet including left and right storage chambers; left and right doors for respectively opening and closing the left and right storage chambers; and a door-opening apparatus for selectively opening and closing the left and right doors.

The door-opening apparatus may include a driving motor rotated in designated regular and reverse directions; a main cam rotated by the driving motor; and a first sub-cam operated by the main cam for opening and closing the left door, and a second sub-cam operated by the main cam for opening and closing the right door.

Further, the first and second sub-cams may be respectively provided with rotary shafts serving as centers of rotation of the first and second sub-cams when the first and second sub-cams are operated by the main cam.

Moreover, the first and second sub-cams may slidably contact the main cam, and be partially protruded from the front surface of the cabinet when the left and right doors are opened.

The first and second sub-cams may be respectively provided with first and second restoring springs for returning the first and second sub-cams to their original positions after the left and right doors are opened.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE EMBODIMENT

Figure 1:
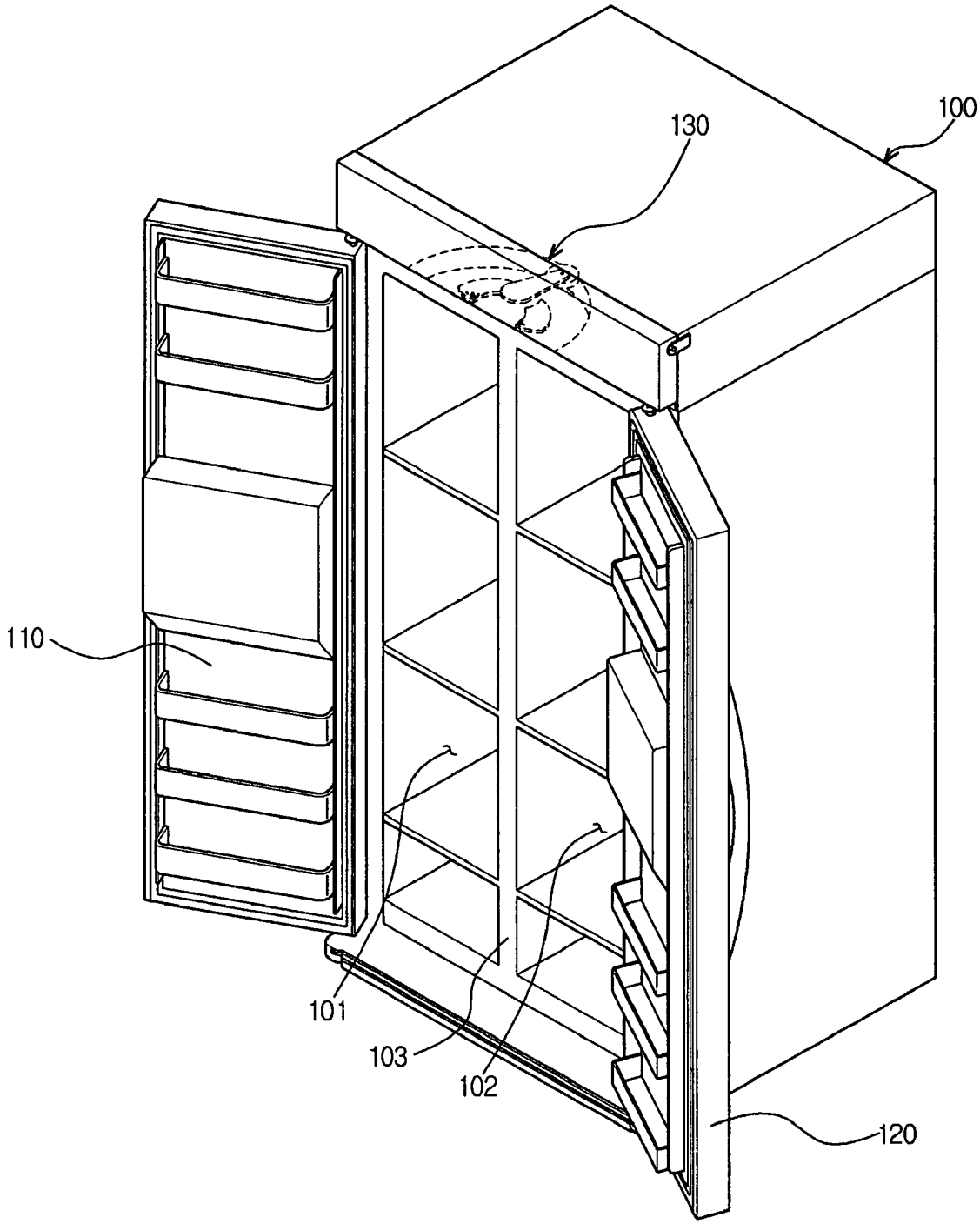
FIG. 1 is a perspective view of a side-by-side refrigerator in accordance with an embodiment of the present invention.

Reference will now be made in detail to the embodiment of the present invention, an example of which is illustrated in the accompanying drawings, wherein like reference numerals refer to like elements throughout. The embodiment is described below to explain the present invention by referring to the annexed drawings.

As shown in FIG. 1, a side-by-side refrigerator in accordance with an embodiment of the present invention includes a cabinet 100 including storage chambers 101 and 102. The inside of the cabinet 100 is divided into the two storage chambers 101 and 102 by a partition 103. Two doors 110 and 120 for respectively opening and closing the two storage chambers 101 and 102 are installed on the front surface of the cabinet 100. Upper and lower parts of the left end of the left door 110 are hinged to the cabinet 100, and the right end of the left door 110 serves as a free terminal. On the other hand, upper and lower parts of the right end of the right door 120 are hinged to the cabinet 100, and left end of the right door 120 serves as a free terminal. Generally, the left storage chamber 101 is used as a freezing chamber, and the right chamber 102 is used as a chilling chamber.

Figure 2:
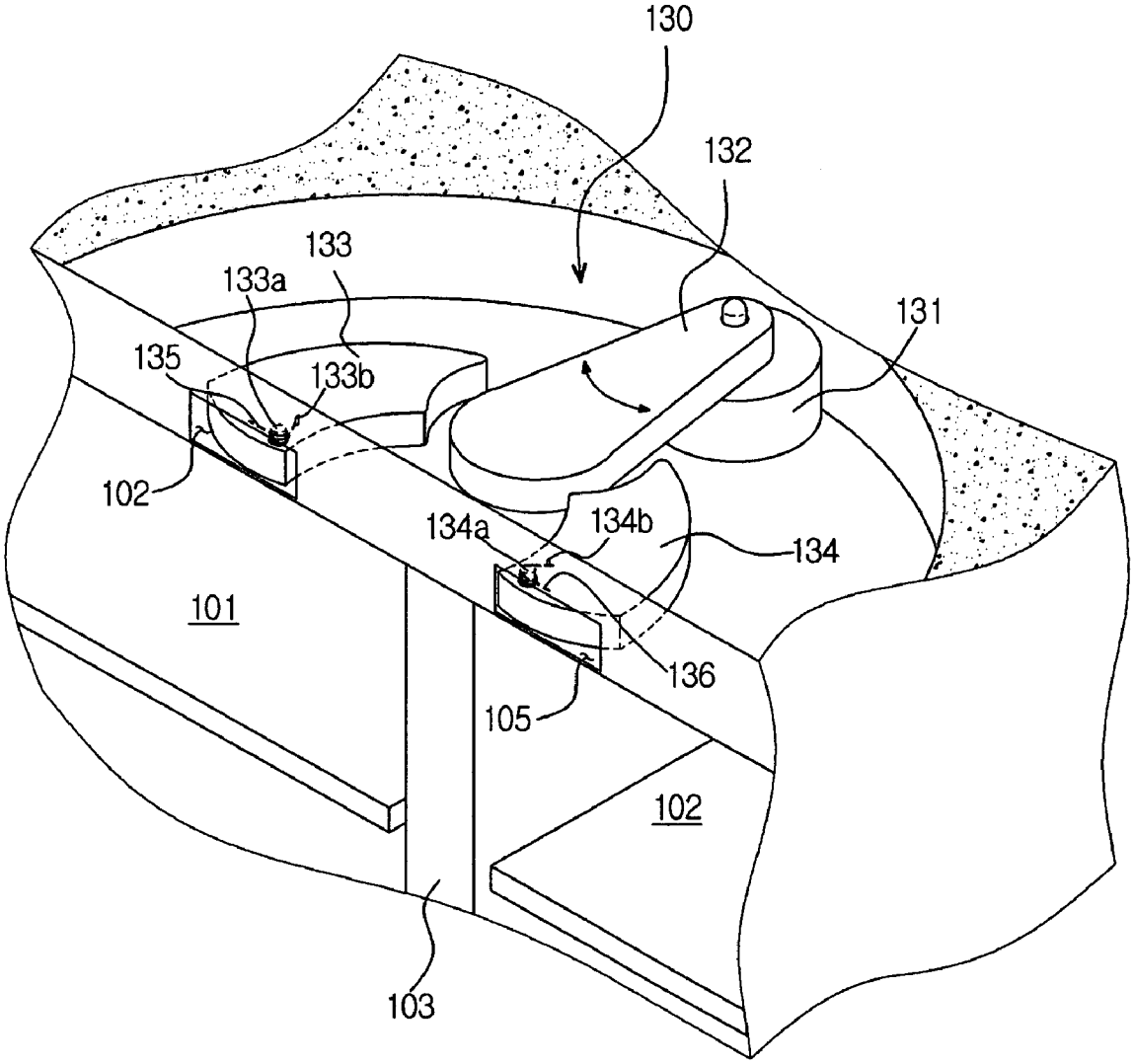
FIG. 2 is a perspective view of a door-opening apparatus of the side-by-side refrigerator of FIG. 1.

A door-opening apparatus 130 for selectively opening the two doors 110 and 120 is installed at the central portion of the upper end of the cabinet 100. As shown in FIG. 2, a space for installing the door-opening apparatus 130 therein is installed in a portion of the cabinet 100 on the partition 103. The door-opening apparatus 130 includes a driving motor 131 rotated in designated regular and reverse directions, a main cam 132, one end of which is connected to a driving shaft of the driving motor 131 and rotated, a first sub-cam 133 operated by the main cam 132 to open the left door 110, and a second sub-cam 134 operated by the main cam 132 to open the right door 120. Both ends of the main cam 132 are curved in a convex shape. The first sub-cam 133 is pushed by the rotation of the main cam 132, and is then rotated. One end of the first sub-cam 133, slidably contacting the end of the main cam 132, is curved in a concave shape. The first sub-cam 133 includes a rotary shaft 133*a* at a corner thereof close to the front surface of the cabinet 100 and the partition 103. A first restoring spring 135 for returning the first sub-cam 133 to its original position, after the left door 110 is opened by the first sub-cam 133, is installed on the rotary shaft 133*a*. The first restoring spring 135 is a coiled spring, both ends of which form a designated angle and the central portion of which is coiled in a cylindrical shape. One end of the first restoring spring 135 is supported by the inside of the front surface of the cabinet 100, and the other end of the first restoring spring 135 is supported by a protrusion 133*b* formed on the first sub cam 133.

The first sub-cam 133 and the second sub-cam 134 have bilaterally symmetrical structures with each other. In the same manner as the first sub-cam 133, the second sub-cam 134 includes a rotary shaft 134*a* at a corner thereof close to the front surface of the cabinet 100 and the partition 103. A second restoring spring 136 for returning the second sub-cam 134 to its original position, after the right door 120 is opened by the second sub-cam 134, is installed on the rotary shaft 134*a*. A protrusion 134*b* for supporting one end of the second restoring spring 136 is installed on the second sub-cam 134.

A first hole 102 is formed through the front surface of the cabinet 100 in the front of the first sub-cam 133, and a second hole 105 is formed through the front surface of the cabinet 100 in the front of the second sub-cam 134. When the door-opening apparatus 130 is operated, the first sub-cam 133 and the second sub-cam 134 are partially protruded to the outside of the front surface of the cabinet 100 through the first hole 102 and the second hole 105.

Although not shown in drawings, the side-by-side refrigerator in accordance with this embodiment further comprises a controller for receiving inputted signals for opening the left door 110 and the right door 120 and operating the driving motor 131 based on the received signals.

Hereinafter, the operation of the side-by-side refrigerator in accordance with the above embodiment will be described.

Figure 3:
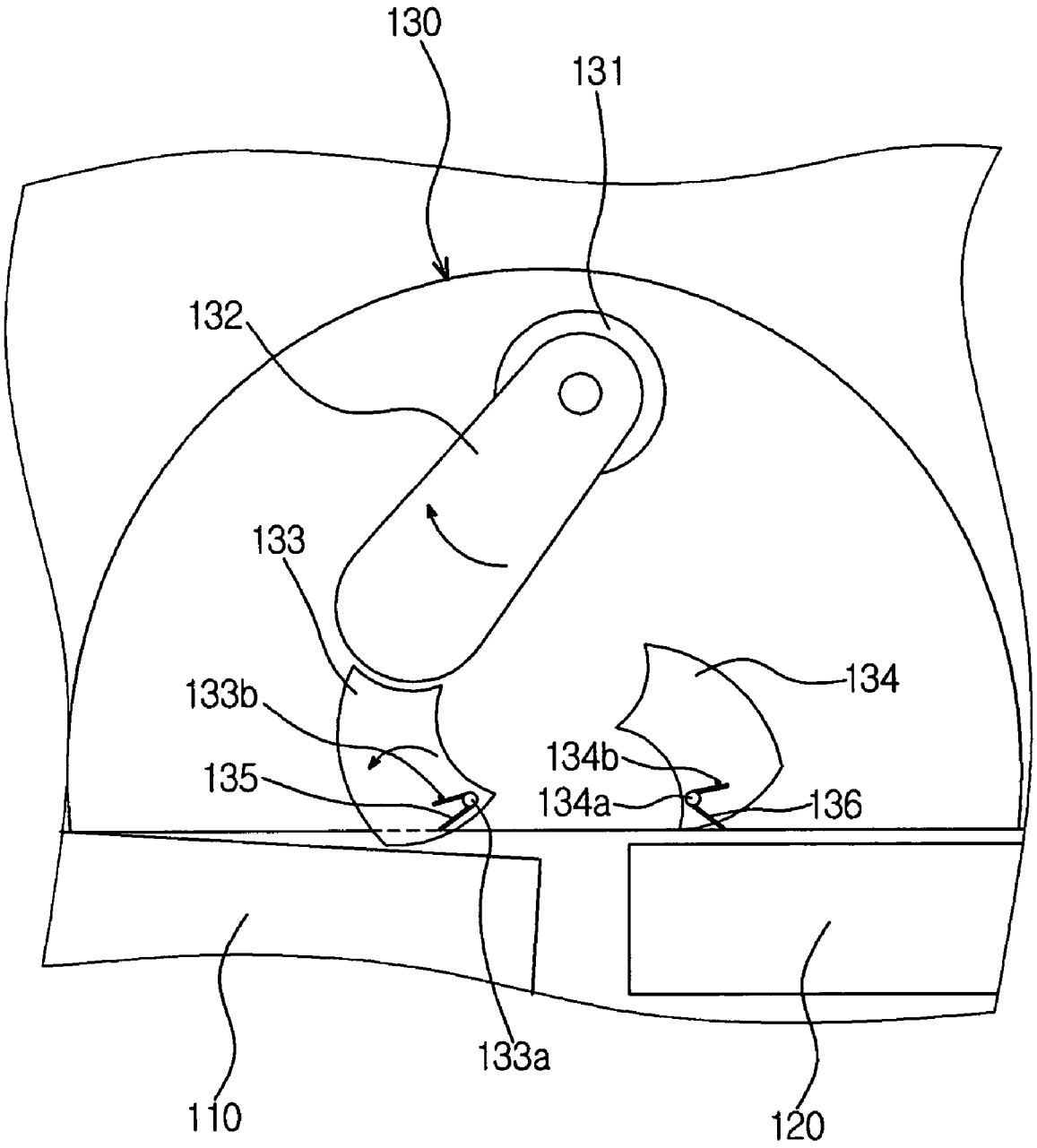
FIGS. 3 and 4 are plan views respectively illustrating operation of the door-opening apparatus of the side-by-side refrigerator of FIG. 1.

When a signal for opening the left door 110 is inputted to the controller, the controller, as shown in FIG. 3, rotates the driving motor 131 in a designated direction so that the main cam 132 is rotated at a designated angle in the clockwise direction. The front end of the main cam 132 slidably contacts the first sub-cam 133, and pushes the first sub-cam 133 so that the first sub-cam 133 is rotated in the counterclockwise direction. Here, the first sub-cam 133 is rotated with respect to the rotary shaft 133*a*, and is partially protruded to the outside of the cabinet 100 through the first hole 104, thereby pushing the left door 110 so that the left door 110 is opened. When the left door 110 is opened, the controller rotates the driving motor 131 in the reverse direction so that the main cam 132 is returned to its original central position. The first sub-cam 133 is returned to its original position by the elastic force of the first restoring spring 135, and the part of the first sub-cam 133, which was protruded to the outside of the cabinet 100, is intruded into the cabinet 100.

Figure 4:
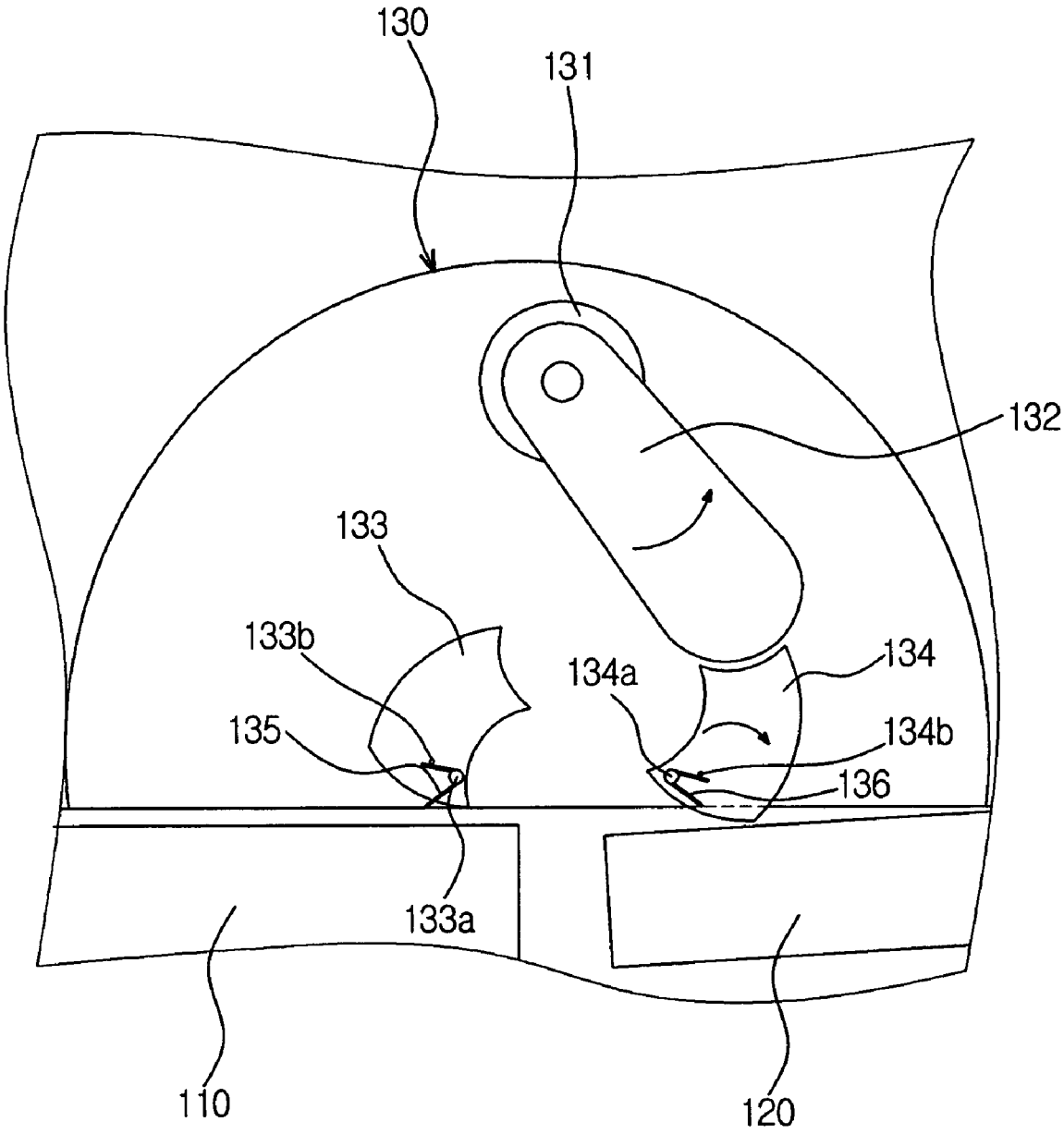

The opening operation of the right door 120 is identical to the opening operation of the left door 110 except that the rotating directions of the driving motor 131 in the opening operation of the right door 120 are reverse to those of the driving motor 131 in the opening operation of the left door 110. When an input signal for opening the right door 120 is inputted to the controller, the controller, as shown in FIG. 4, rotates the main cam 132 at a designated angle in the counterclockwise direction. Then, the second sub-cam 134 is rotated in the clockwise direction, and is partially protruded to the outside of the cabinet 100 through the second hole 105, thereby pushing the right door 120 so that the right door 120 is opened. When the right door 120 is opened, the controller rotates the driving motor 131 in the reverse direction so that the main cam 132 is returned to its original central position. The second sub-cam 134 is returned to its original position by the elastic force of the second restoring spring 136.

As apparent from the above description, the present invention provides a side-by-side refrigerator having a door-opening apparatus for selectively opening two doors so that the doors are easily opened.

The door-opening apparatuses are not respectively provided on the two doors, but a single door-opening opening apparatus includes a driving motor, a main cam, and first and second sub-cams operated by the main cam, thereby having a simple structure and reduced production costs.

Although an embodiment of the invention has been shown and described, it would be appreciated by those skilled in the art that changes may be made in this embodiment without departing from the principles and spirit of the invention, the scope of which is defined in the claims and their equivalents.

What is claimed is:

1. A side-by-side refrigerator comprising:

a cabinet including left and right storage chambers;

left and right doors for respectively opening and closing the left and right storage chambers;

a door-opening apparatus for selectively opening the left and right doors;

a driving motor rotated in designated regular and reverse directions;

a main cam rotated by the driving motor; and a first sub-cam operated by the main cam for opening the left door, and a second sub-cam operated by the main cam for opening the right door, wherein the first sub-cam or the second sub-cam is respectively operated as the main cam is rotated in the regular direction or in the reverse direction, and wherein the first and second sub-cams are respectively provided with first and second restoring springs for returning the first and second sub-cams to their original positions after the left and right doors are opened.

2. The side-by-side refrigerator as set forth in claim 1, wherein the first and second sub-cams are respectively provided with rotary shafts serving as centers of rotation of the first and second sub-cams when the first and second sub-cams are operated by the main cam.

3. The side-by-side refrigerator as set forth in claim 2, wherein the first and second sub-cams slidably contact the main cam, and are partially protruded from the front surface of the cabinet when the left and right doors are opened.

4. The side-by-side refrigerator as set forth in claim 1, wherein the first sub-cam is provided with a protrusion for supporting one end of the first restoring spring.

5. The side-by-side refrigerator as set forth in claim 1, wherein the second sub-cam is provided with a protrusion for supporting one end of the second restoring spring.

* * * * *